United States Patent [19]

Färber

[11] 4,442,970

[45] Apr. 17, 1984

[54] PACKAGE FOR LIQUIDS

[75] Inventor: Jürgen Färber, Kaarst, Fed. Rep. of Germany

[73] Assignee: PKL Papier-und Kunstoff Werke Linnich GmbH, Dusseldorf, Fed. Rep. of Germany

[21] Appl. No.: 375,776

[22] Filed: May 6, 1982

[30] Foreign Application Priority Data

May 29, 1981 [DE] Fed. Rep. of Germany ..... 312141

[51] Int. Cl.[3] ..... B65D 5/74

[52] U.S. Cl. ..... 229/17 G

[58] Field of Search ..... 229/17 G, 17 R, 7 R

[56] References Cited

U.S. PATENT DOCUMENTS 2,634,896 4/1953 Graveno ..... 229/17 G 3,024,959 3/1962 Kuchenbecker ..... 229/17 G 4,332,577 6/1982 Mosse ..... 229/17 G

*Primary Examiner*—Herbert F. Ross

*Attorney, Agent, or Firm*—Sprung, Horn, Kramer & Woods

[57] ABSTRACT

In a blank for folding into a parallelepipedal package that is intended for liquids, the blank having an area that is to be folded into a double-M closure for a gable-shape top having inwardly folded opposite triangular sections and a middle fold line, the improvement which comprises providing each of said opposite triangular sections with a slit that slants from the upper edge down to or slightly beyond the middle fold line, whereby the folded package has an improved seal. When the cross-section is square, the slits should be parallel so that the folded areas dogleg and overlap.

4 Claims, 6 Drawing Figures

PACKAGE FOR LIQUIDS

Figure 1:
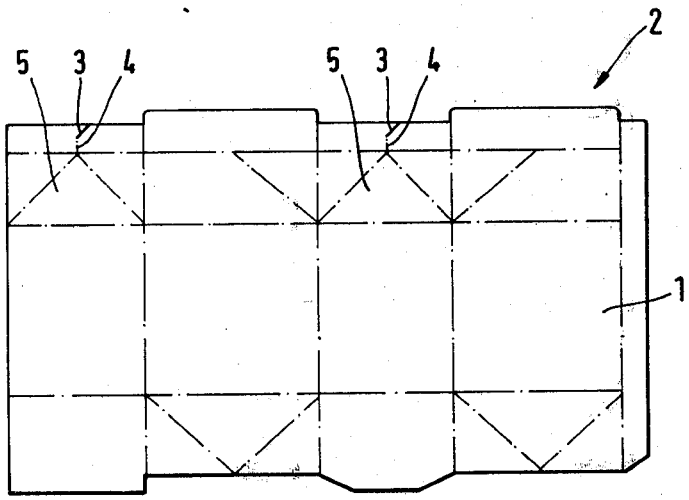

The invention is a parallelepipedal package that is intended for liquids, that is made of cardboard, especially plastic-coated cardboard, and that has a gable-shaped top formed by folding the upper side of the package into a double-M closure.

Inwardly folded web seams, which when employed as closures are also known as double-M closures because of their shape when viewed from above, are found in many different types of paper bags and packages. This type of closure is not however essentially restricted to any particular cross-section. They may have types of cross-section, which differ mainly in the distance between the peaks of the inward folds. These peaks can be separated, in contact, or more or less overlapped.

Such packages are closed by cementing or preferably sealing, and there are always problems related to tightness, especially when the packages are to contain liquids or hygroscopic materials. Manufacturing tolerances readily permit channels, through which liquid can leak from the closed package, to form at the transitions from four to two layers of material.

Attempts have previously been made to solve these problems by graduating the cheek plates used to seal the package. To the extent that the geometry of the package allows, longitudinal seams can also be made in the area between the peaks of the folds.

Although such measures may be appropriate for special cases, the problem of leakage has not been solved in general.

The present invention is intended as an improvement in packages that are intended to contain liquids and the employ the double-M type of closure, such that no channels can form when the packages are folded up and sealed and such that they will not leak.

This goal is attained, in the embodiment of a parallelepipedal package for liquids in accordance with the invention by providing each of the inwardly folded triangles in the vicinity of the peaks of the folds with a slit that slants in a straight or inflected path down from the trimmed edge (upper edge) of the blank to or slightly beyond the straight groove that determines the peak of the fold.

When the package is folded into its final form, the apex of the inwardly folded triangular section will end at the slit, leaving a flap in the plane of the side. There will be no abrupt transitions from four to two layers of material at the peaks of the folds in the resulting web seam. The flaps and the straight or inflected slit will result in single-step or single-layer transitions from four to three or two layers, in both the longitudinal and transverse direction of the plane of closure in fact.

When the packages have a square cross-section and are made of cardboard coated on both sides with plastic, the slits in one preferred embodiment of the invention are parallel and the flaps dogleg when they overlap.

A dogleg overlap will securely seal off even such layer channels as may be necessitated by the manufacturing process, and when the cardboard is coated on both sides with plastic, the resulting resiliency of the cardboard layers will provide additional sealing material, so that the trimmed edges of the flap will be covered with as much plastic as possible.

The type of overlap, dogleg or not, is determined by the way the package is guided during folding and closing.

The invention will now be described with reference to the drawings, in which

Figure 2:
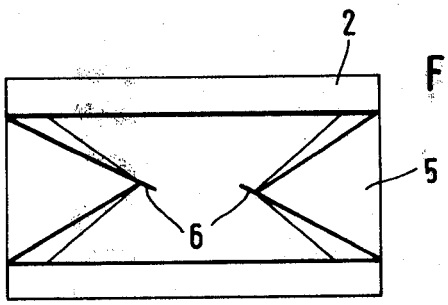
Figure 3:
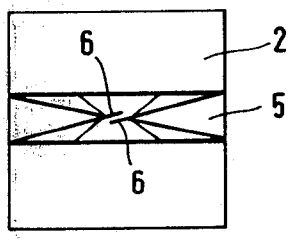
Figure 4:
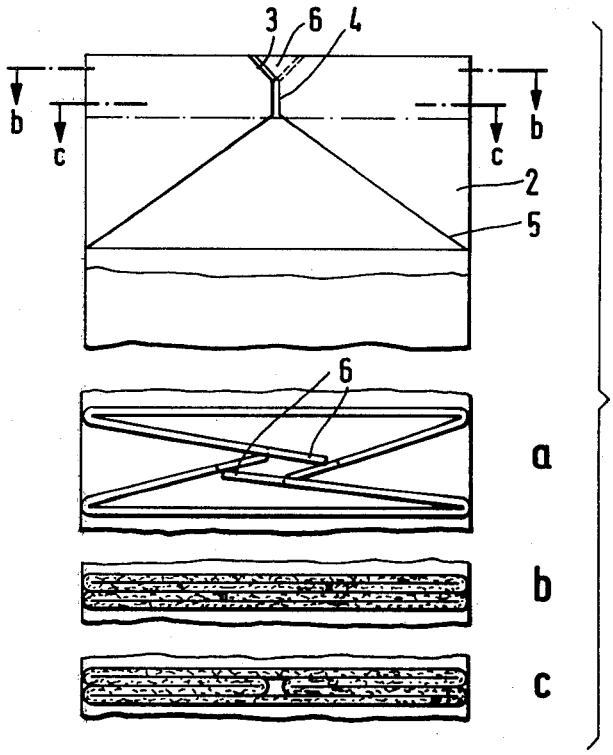
Figure 5:
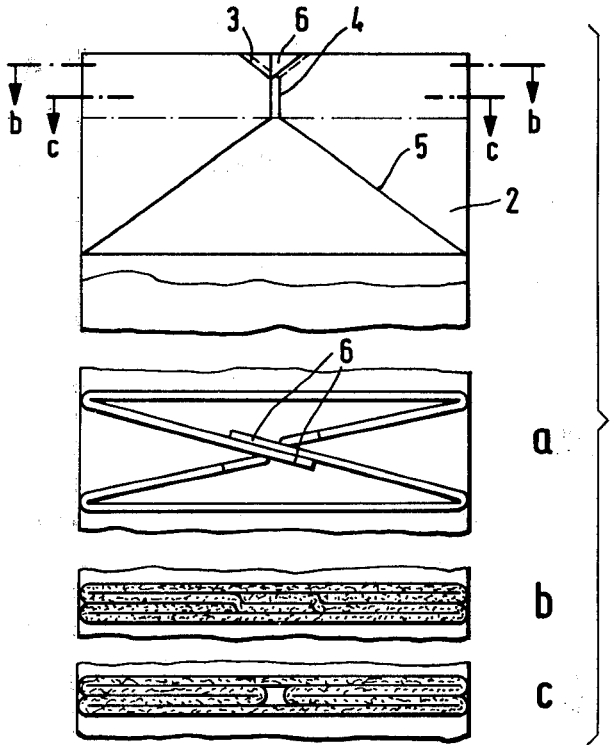
Figure 4D:
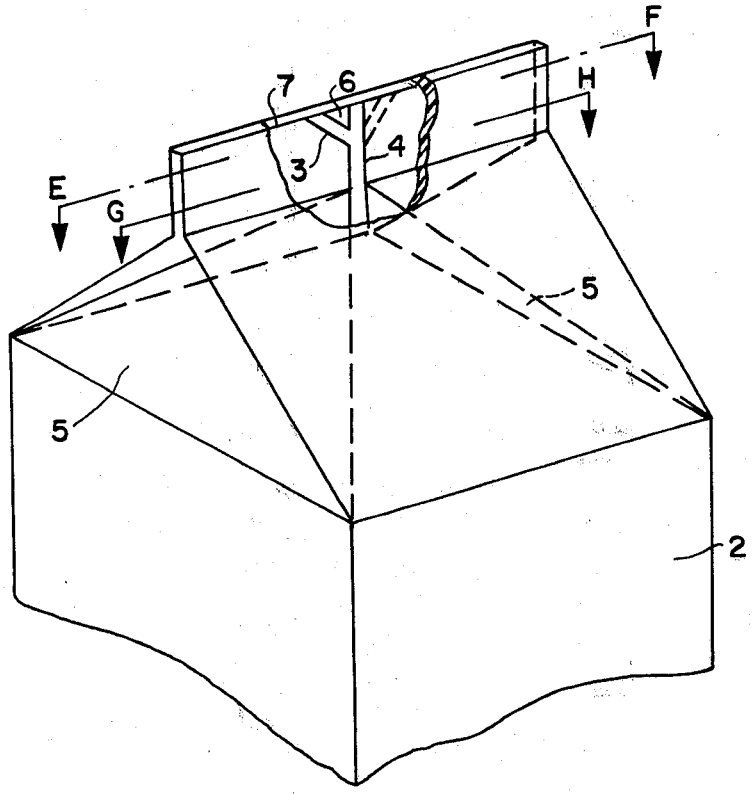

FIG. 1 shows a blank,

FIG. 2 is a top view of parallelepipedal package that has not yet been closed, FIG. 3 a top view of a package with a square cross-section, FIG. 4 a side view of, (a) a top view of, and (b) and (c) two sections through the upper portion of a package with a square cross-section without dogleg overlap and (d) a perspective view thereof, and FIG. 5 a side view of, (a) a top view of, and (b) and (c) two sections through the upper portion of a package with a square cross-section with dogleg overlap.

FIG. 1 shows slits 3 in accordance with the invention in the blank 1 for a package 2. Slits 3 slant down from the upper edge of blank 1 to the middle fold line 4 of the inwardly folding triangular section 5 on the "gable end" of the package.

Slits 3 form triangular flaps 6, which are particularly evident in the top views in FIGS. 2 and 3. The peaks of the folds in the package 2 with a rectangular cross-section illustrated in FIG. 2 do not touch, whereas the peaks 6 in the package 2 with a square cross-section illustrated in FIG. 3 do overlap, whether or not they dogleg.

The meaning of "doglegging" will be obvious from FIGS. 4 and 5. FIG. 4 shows a package in which the overlapping flaps 6 do not dogleg and FIG. 5 the preferred type of doglegging overlap. The latter design reliably eliminates channels in the closed package.

As FIG. 1 shows, the two slits 3 in blank 1 are parallel. When package 2 is folded into its final form, slit 3 on the opposite gable ends will run in different directions. This is, however, only necessary when the package has a square cross-section so that the flaps 6 formed by slits 3 must overlap. When the package has a rectangular cross-section and flaps 6 do not have to overlap, slits 3 do not have to be parallel.

It will be understood that the specification and examples are illustrative but not limitative of the present invention and that other embodiments with the spirit and scope of the invention will suggest themselves to those skilled in the art.

What is claimed is:

1. In a plastic-coated cardboard blank for folding into a parallelepipedal package that is intended for liquids, the blank having opposite triangular areas that are to be folded inwardly into a double-M closure for a gable-shaped top and such areas each has an upper edge and a middle fold line extending to the apex of said triangular area, the improvement which comprises providing each of said opposite triangular areas with a slit that slants from the upper edge down to at least to the middle fold line to form a non-folding flap, whereby the folded package has an improved seal.

2. A blank according to claim 1 for folding into a package of square cross-section, wherein the slits in the blank are parallel so that when the package is folded closed the folded areas may dogleg and overlap.

3. A package produced by folding the blank of claim 1.

4. A package of square cross-section produced by folding the blank of claim 2, the folded areas dogleg and overlap.

* * * * *